United States Patent [19]

Cook

[11] Patent Number: 4,913,476

[45] Date of Patent: Apr. 3, 1990

[54] DOOR LATCH AND RELEASE APPARATUS

[75] Inventor: Nathan M. Cook, Rochester, Minn.

[73] Assignee: Crenlo, Inc., Rochester, Minn.

[21] Appl. No.: 228,066

[22] Filed: Aug. 4, 1988

[51] Int. Cl.[4] ..... E05C 3/08

[52] U.S. Cl. ..... 292/196; 292/DIG. 69; 292/DIG. 72

[58] Field of Search ..... 292/196, 221, 233, 223, 292/240, 241, 191, 192, DIG. 71, DIG. 72, DIG. 68, DIG. 69

[56] References Cited

U.S. PATENT DOCUMENTS

| | | | |
|---|---|---|---|
| 2,557,670 | 6/1951 | Luft | 70/72 |
| 2,789,851 | 4/1957 | Lickteig | 292/98 |
| 2,901,277 | 8/1959 | Anderson | 292/78 |
| 3,045,465 | 7/1962 | Larson | 292/223 X |
| 3,262,726 | 7/1966 | Phelps | 292/196 |
| 3,374,018 | 3/1968 | Lust | 292/45 |
| 3,464,729 | 9/1969 | Chambers | 292/218 |
| 3,490,804 | 1/1970 | Little | 292/240 |
| 3,743,336 | 7/1973 | Andrews | 292/191 X |
| 4,003,614 | 1/1977 | Geer et al. | 312/320 |
| 4,365,490 | 12/1982 | Manyoni | 292/221 X |

*Primary Examiner*—Richard E. Moore
*Attorney, Agent, or Firm*—Kinney & Lange

[57] ABSTRACT

A door latch and release apparatus is for moving a door into a finally closed condition with respect to a door frame and initially moving the door out of its closed condition to overcome the force of compressing or decompressing a continuous metallic gasket extending around the entire periphery between the door and the door frame. A handle on the door is linked to one end of a rocker arm which is pivotally mounted on the door. An antifriction rocker arm roller is rotatably mounted on the other end of the rocker arm in position to lie between a latch edge portion of the door frame and a latch plate finger fixedly supported with respect to the door frame latch edge portion. With the door handle in its open position, the door is closed until the roller contacts the door frame latch edge portion, and then the handle is manually moved to its closed position with the roller rolling on the finger to finally close the door with enough force to easily compress the metallic gasket between the door and the frame. To open the door, the door handle is moved toward its open position, and the rocker arm roller moves against the door latch edge portion and rolls against that portion to overcome the frictional forces due to the compressed gasket initially resisting opening movement of the door.

4 Claims, 3 Drawing Sheets

Fig.1
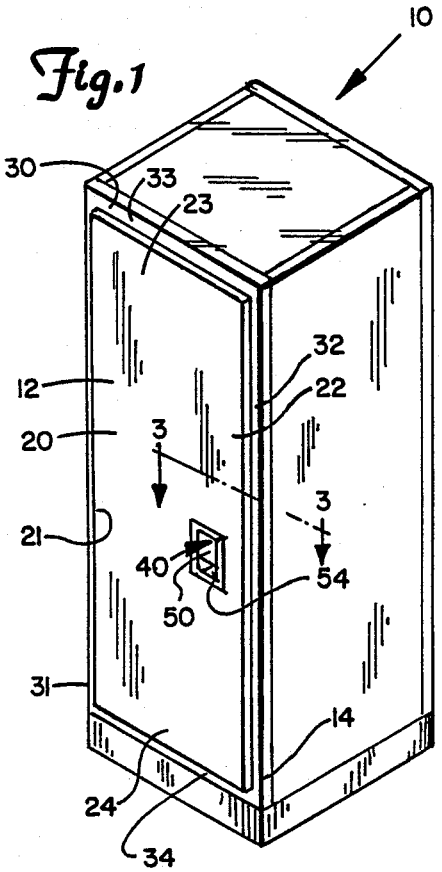
Fig.2
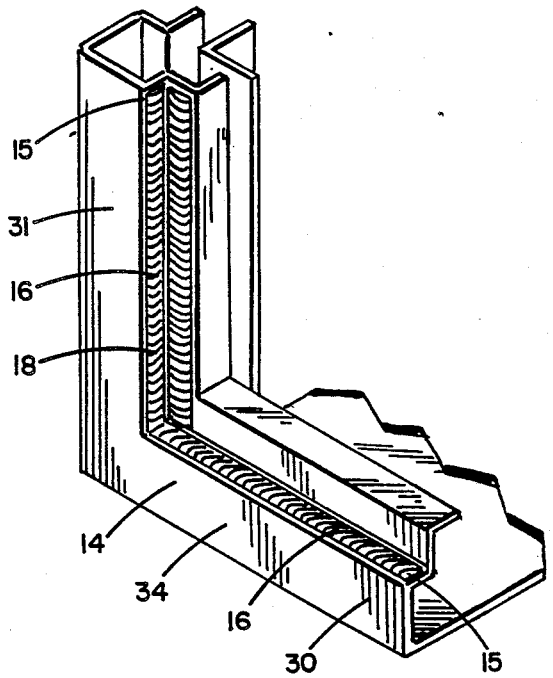
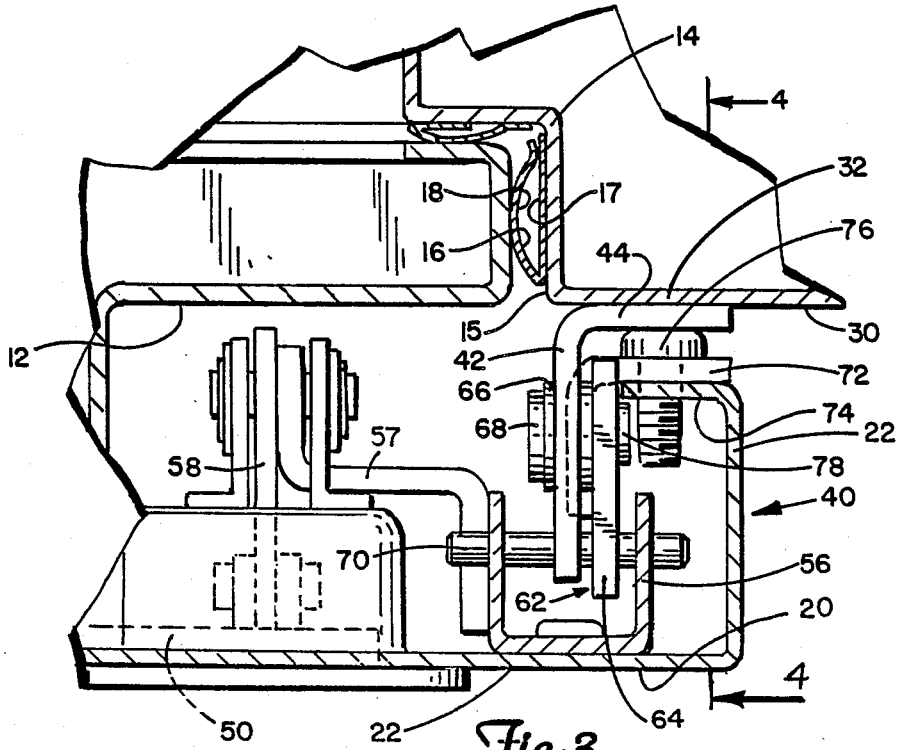
Fig.3

DOOR LATCH AND RELEASE APPARATUS

BACKGROUND OF THE INVENTION

1. Field of the Invention

This invention has relation to door latch apparatus for positively accomplishing the final movement of a door to its closed position in a door frame and for initially positively moving the door from its fully closed position to a position where one edge of the door is entirely clear of the door frame in a structure where considerable force must be applied to engage and disengage a gasket around the periphery of the space between the door and frame.

2. Description of the Prior Art

It is often advantageous to seal a cabinet to diminish the possibility of travel of uninterrupted electromagnetic waves into or out of the cabinet. Microwave ovens are one example of such cabinets, but there are also uses for such cabinets as envelopes sealed against other electromagnetic radiation. Such cabinets can constitute all metal envelopes, and at every junction of the various metal components, electrical continuity between components must be established and maintained.

In order to seal the entrance door of such a cabinet to its door frame, it is known to provide a continous metallic gasket between the door and the door frame. Such gaskets can run around the entire inner periphery of the door frame and are so shaped that when the door is closed tightly, the gasket is firmly compressed between the door and the door frame all the way around the edge of the door and the frame.

In compressing the metallic gasket along the top edge and the bottom edge of the door and door frame, the compression is progressive, inch by inch, as the door is hinged shut. Along the hinged edge and along the latch edge, however, compression of the gasket happens only during the very last movement of the door as it closes. There is no such incremental progression. Thus, a relatively much greater force is necessary to finally push the door shut against the door frame to overcome the bias forces of the metallic spring gasket between the hinged edge and the latch edge of the door and frame. For the same reasons, a greater force of similar magnitude is required to initially move the door from its closed position to position clear of that part of the gasket along the latch and hinge edges.

The concept of a door latch and release apparatus which uses the closing movement of the door handle to forceably draw a door into sealing relationship with respect to its cabinet, and which uses the initial opening movement of such a handle to forceably start movement of the door away from the cabinet is old and well known.

In U.S. Pat. No. 2,557,670 granted to Luft on June 19, 1951, a handle H on a cabinet wall moves a vertical link 60 up and down to pivot a hook 52, 53, 54 of a cam-lock arm 49 into fastening relation with respect to a slot 55 in a keeper bar 56 anchored on a door 18.

To get maximum access to the interior of cabinets of the present invention, the door customarily covers one entire wall of the cabinet. This structure of Luft is not, therefore, adaptable to obtain a substantially firm metallic seal all the way around the door and door frame because of the use of the vertical link sliding up and down the interior of the trunk wall.

U.S. Pat. No. 3,374,018 granted to Lust on Mar. 19, 1968 shows a snap-action catch in which a slidable thrust rod on a cabinet door rotates a hook cam on the door to engage a latch pin on a cabinet. The hook cam structure as shown in this patent, and the similar structures as shown in the patent to Luft, and in the patents discussed below, all present a high friction arrangements. Such structures have been tried and found to be ineffective to provide the force necessary to finally close and initially open electromagnetic radiation-tight cabinets such as used in connection with the present invention.

U.S. Pat. No. 3,464,729 granted to Chambers on Sept. 21, 1969 shows a vertical rod 22 which is rotatably mounted to a door and is controlled by a handle 7. The rod has a cam 2' at the top end and a cam 2 at the bottom end, and as the door is almost shut, the rod is rotated and each of these cams interacts with pins 4 and 5 of seatings 3' and 3 to finally force the door closed. Reversing the action of the handle will initially force the door open slightly.

In the context of the present invention, the dimensions of the cams 2',2 and of the pins 4,5 is such that sufficient powered movement of the latch edge of the door toward the door frame cannot be achieved without going to large and awkward configurations. Perhaps more important, however, is that this mechanism of Chambers is useful to positively position only the very top edge and the very bottom edge of the door to the door frame. Multiple latches cannot be provided along the latch edge of the door at intervals such as is often necessary or advisable in sealing the doors of radiation-tight boxes or cabinets useful with the present invention.

U.S. Pat. No. 4,003,614 granted to Geer et al on Jan. 18, 1977 shows a door mounted hook operated by a handle 16 to engage a transversely extending keeper 26. The hook extends through an opening in the cabinet wall, rendering the structure unuseable in the present context.

U.S. Pat. No. 2,789,851 granted to Lickteig on Apr. 23, 1957 is another high friction hook and latch arrangement for clamping a swinging window tightly against a window sill. As suggested above, this structure will not be useful for sealing cabinets like those described herein.

U.S. Pat. No. 3,262,726 granted to Phelps on July 26, 1966 and U.S. Pat. No. 3,490,804 granted to Little on Jan. 20, 1970 both show latch mechanisms to hold casket covers down hard against a gasket or other sealing device. These are ineffective because they are just a hook and latch arrangement where brute force is used to overcome excessive friction. Since they relate to caskets, these structures, after all, only have to be sealed one time and then must hold "forever." They will not be useful to provide the over-and-over, repeated operation which the latch apparatus of the present invention must provide.

U.S. Pat. No. 2,901,277 granted to Anderson on Aug. 25, 1959 is another simple hook shape latch and keeper arrangement but one that is spring loaded. It is effective in all probability for use on the refrigerator door for which it is designed. However, it cannot be adapted to provide several latch points along the latch edge of a door and door frame. Also, the structure is not such as to provide the same force toward opening the door as is provided to pull the door closed to compress a soft rubber sealing gasket.

What was needed before the present invention was a positive door latch and release apparatus which would "take hold" at the time a door first came into contact with a solid strip of metal gasket on the hinge and latch edges of a door frame; would operate to pull the door powerfully, positively, and with little friction firmly down against the door frame while compressing the gasket along the latch edge and the hinge edge of the frame; and then, when the action of the handle is reversed, would positively push the door away from the frame until it was clear of the frame and the gaskets along the hinge and latch edges of the frame.

Neither the inventor nor those in privity with him are aware of any prior art which is closer than that discussed above, or of any prior art which anticipates the claims set out herein.

SUMMARY OF THE INVENTION

This invention presents a positive door latch and release apparatus for use in positively moving a door into a finally closed condition with respect to a door frame and initially moving that door out of its closed condition with respect to the door frame when there are substantial forces tending to resist movement of the door into its finally closed condition and substantial forces tending to retain the door in its closed condition once it arrives into that condition.

This door latch apparatus includes at least one latch plate fixedly mounted with respect to a latch edge of a door frame opposite the door frame hinged edge. This latch plate extends outwardly from the door frame in direction toward the door in position to be in alignment with a latch edge portion of the door when the door is closed. The latch plate is provided with a latch plate finger in spaced relation away from the door frame latch edge and the finger extends in parallel relation to the door frame latch edge.

The apparatus also includes an elongate slide bar slidably mounted with respect to the latch edge portion of the door for longitudinal movement in direction parallel to the door latch edge between an open end and a closed position, the slide bar having at least one transversely extending rocker arm actuating slot therein.

The apparatus also includes a door latch handle accessible from the outside face of the door and manually movable between an open and a closed position; and means linking the door handle with the slide bar, such linking means being operable to move the slide bar between an open and a closed position upon movement of the handle between its open and closed positions.

The apparatus is provided with at least one rocker arm assembly including: (1) a rocker arm pivotally mounted with respect to the latch edge portion of the door and effectively pivoting in a plane parallel to the plane of the latch plate finger as the door nears its closed condition, (2) a rocker arm roller rotatably mounted to a first end portion of the rocker arm in position to lie in the plane of the latch plate finger, and (3) a rocker arm pin fixedly mounted to a second end portion of the rocker arm, extending transversely of the plane of movement of the rocker arm and situated within a rocker arm actuating slot of the slide bar.

The parts are so configured and positioned that with the handle and slide bar in open position as the door is swung toward its closed condition, the rocker arm roller will initially contact the latch edge of the door frame. With this roller in contact with the door frame, the door handle can be moved manually from open toward closed position, causing the roller to contact the underside of the latch plate finger. Further movement of the door handle toward closed position will cause the rocker arm assembly to force the roller against the latch plate finger drawing the door positively to its finally closed condition against the substantial forces tending to resist movement of the door toward closed condition.

To open the door, the door handle is moved from its closed position toward its open position, and this initially moves the rocker arm roller into contact with the door frame latch edge portion. Further opening of the door handle will force the roller out against this door frame latch edge portion, thus forcing the door open positively for sufficient distance to clear the element which is providing substantial force tending to resist movement of the door from its closed toward its open condition.

Multiple latch plates can extend outwardly from the latch door frame edge, multiple rocker arm actuating slots are provided in the slide bar, and multiple rocker arm assemblies are pivoted to the door so that the door can be positively closed and positively opened and held firmly in closed position in as many locations as are necessary along the length of the door and door frame latch edge to overcome whatever substantial force is operative to inhibit final closing and initial opening of the door in the door frame.

BRIEF DESCRIPTION OF THE DRAWINGS

FIG. 1 is a perspective view of an electromagnetic radiation-tight cabinet showing a door and door frame in closed condition with respect to each other and showing a door handle of a latch and release apparatus, of the present invention for accomplishing these closed conditions;

FIG. 2 is an enlarged fragmentary perspective view of the door frame of FIG. 1 showing a hinged edge portion and a bottom edge portion of the frame, and showing a portion of an attached continuous metallic gasket which must be compressed in order to move the door into a closed condition and the friction of which must be overcome in order to initially the door out of closed condition;

FIG. 3 is an enlarged fragmentary horizontal sectional view taken on the line 3—3 in FIG. 1;

BRIEF DESCRIPTION OF THE PREFERRED EMBODIMENT

Figure 6:
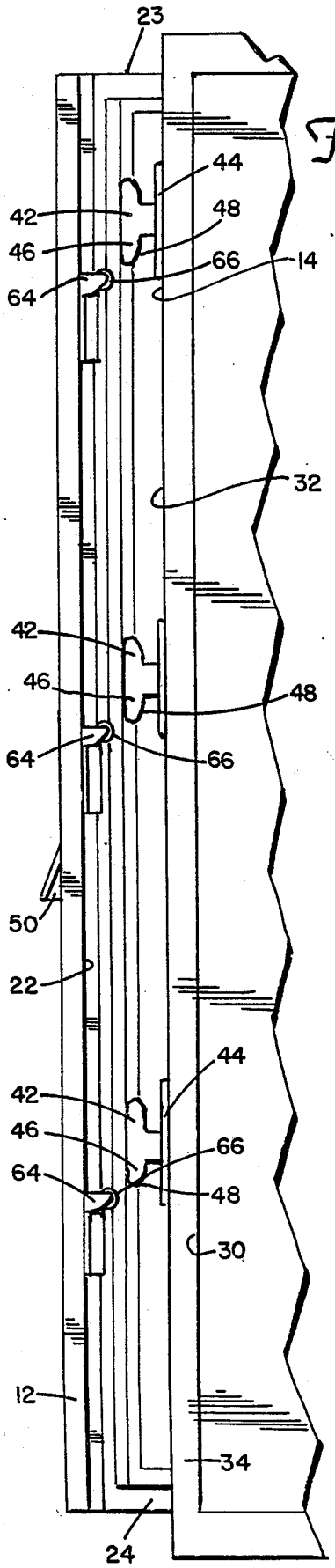
FIG. 6 is a fragmentary sectional view of the cabinet of FIG. 1 as seen from the right in FIG. 3 and showing the positioning of certain visible parts of the apparatus of the invention when the door is ajar.

An electromagnetic radiation-tight cabinet 10 includes a door 12 adapted to be moved between open and closed condition with respect to a door frame 14. In order to perfect the radiation-tight seal between the door and its door frame, a continuous gasket 16 is permanently installed in the door frame around the entire inner periphery 15 thereof. As best seen in FIG. 3, this gasket includes a flat base leg 17 permanently attached to the door frame inner periphery 15, and a bowed compressible leg 18 extending integrally outwardly from the base leg 17. Attachment of the base leg to the door frame can be accomplished in any usual or preferred manner such as by riveting or spot welding. In the form of the invention as shown, the base leg 17 is illustrated as being attached to the inner periphery 15 of the door frame 14 by the use of an adhesive between the base leg and door frame periphery.

In the form of the invention as shown, a pair of vertical secondary gaskets 19,19, one similarly fastened to each one of the outwardly facing surfaces of a hinged edge portion and a latch edge portion of the door frame 14. As best seen in FIG. 3, each of gaskets 19,19 must be compressed as door 12 moved into its closed condition.

The door is partially defined by a front outside surface 20, a first door hinged edge portion 21, a second door latch edge portion 22, a top door edge portion 23 and a bottom door edge portion 24.

The door frame includes a front outside surface 30, a first door frame hinged edge portion 31, a second door frame latch edge portion 32, a top door frame edge portion 33, and a bottom door frame edge portion 34.

Door latch and release apparatus 40 of the present invention includes a plurality of latch plates 42 each lying in a single plane and each extending outwardly from the second door frame hinged edge portion 32 in normal relation to the front outside surface 30 of the door frame. Each latch plate is permanently mounted in that position through the instrumentality of a latch plate positioning flange 44 integral with the latch plate 42 and extending from it at right angles. In the form of the invention as shown, each latch plate is provided with a downwardly extending finger 46 which is partially defined by an inwardly facing working surface 48.

The door latch and release apparatus 40 also includes a door latch handle 50 pivotally mounted as at 52 with respect to the front outside surface 20 of door 12 in an appropriate opening 54 in door 12.

A slide bar 56 is slidably mounted in adjacent relation to the latch edge portion 22 of the door for longitudinal movement in direction parallel to door latch edge. A means for linking the door latch handle 50 to the slide bar 56 is provided in the form of an offset slide bar operating plate 57 and a connecting link 58 pivotally attached with respect to the door latch handle and with respect to the slide bar operating plate 57. In the form of the invention as shown, the slide bar 56 is constituted as a channel member and is provided with a plurality of transversely extending rocker arm actuating slots 60, each slot being in adjacent relation to one of the latch plate fingers 46 when the door is in closed condition with respect to the door frame.

Figure 4:
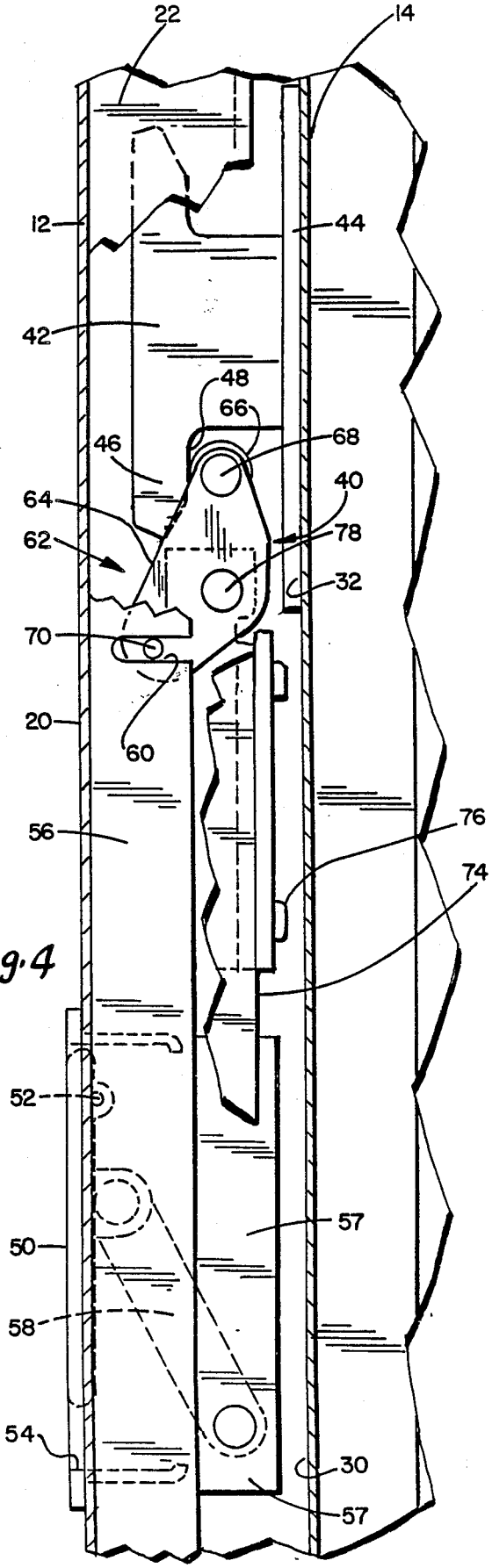
FIG. 4 is a fragmentary vertical sectional view taken on the line 4—4 in FIG. 3 showing the relative position of the parts when the door is in closed condition respect to the door frame.
Figure 5:
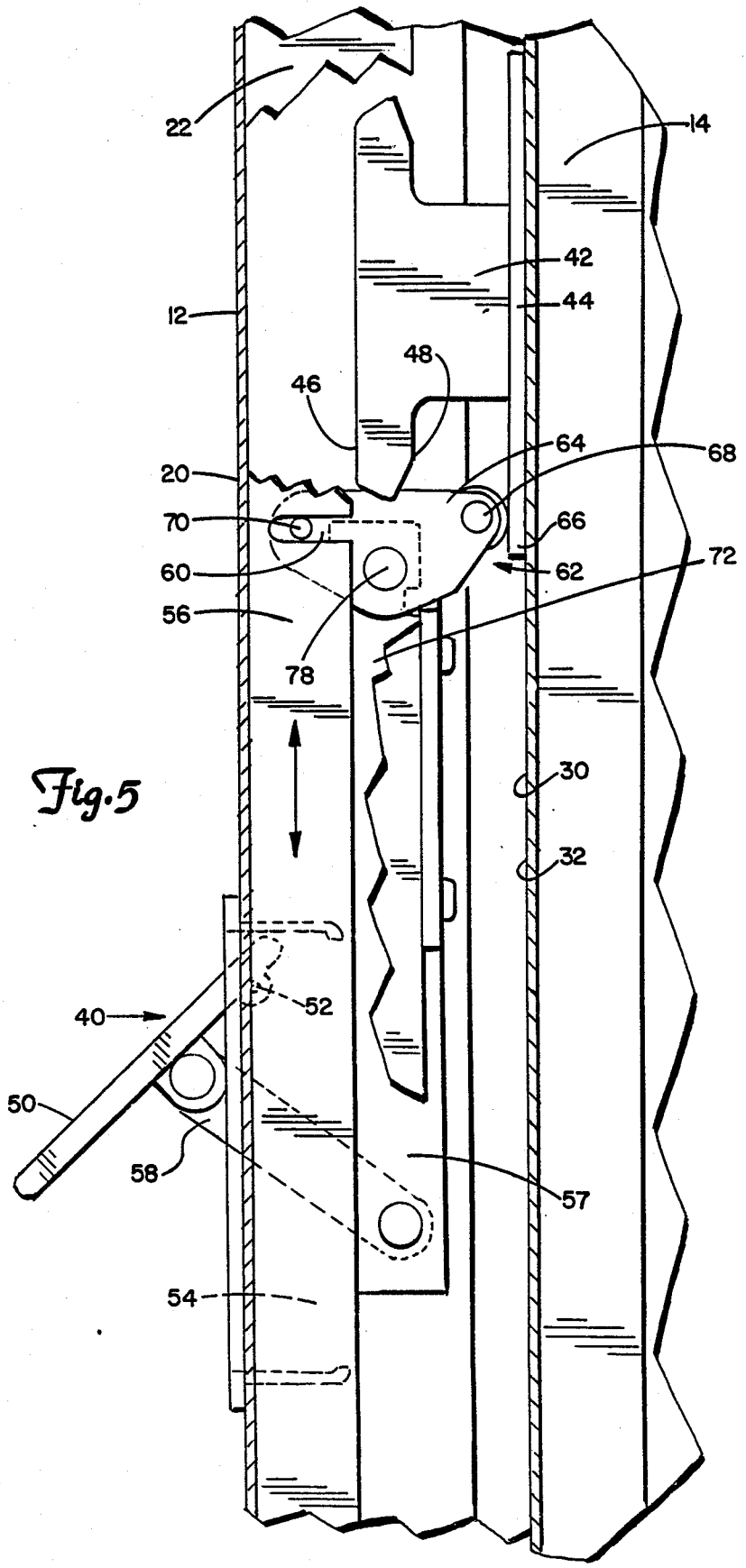
FIG. 5 is also a fragmentary vertical sectional view taken on the line 4—4 in FIG. 3 but showing the parts positioned as they appear after the apparatus of the invention has overcome the initial frictional force of the continuous gasket along a hinged edge and a latch edge of the door frame tending to retain the door in its closed condition.

For each latch plate 42, there is a rocker arm assembly 62 including a rocker arm 64 which is pivotally mounted to a fixed point on the door latch edge portion 22 of the door 12. As perhaps best seen in FIG. 3, this is accomplished by bolting an L-shape rocker arm support plate 72 to an inwardly extending flange 74 of the door latch edge portion 22 of the door 12 through the instrumentality of cap screws 76. As best seen in FIGS. 4 and 5, a boss 78 extends outwardly from each L-shape rocker arm support plate 72, and each pivotally supports a rocker arm 64.

Each rocker arm assembly 62 also includes a rocker arm antifriction roller 66 rotatably mounted as at 68 to a first end portion of a rocker arm 64, and a rocker arm actuating pin 70 fixedly mounted and extending outwardly from a second end portion of such rocker arm 64 to have a longitudinal axis parallel to and spaced from the pivot axis of the rocker arm 64.

OPERATION

With the handle in a first "up" position as seen in FIG. 5, the link 58 will have moved slide bar operating plate 57, and consequently the slide bar 56 to its first position. The rocker arm acutating pin 70, being trapped in one of the transversely extending rocker arm actuating slots 60 will have positioned the rocker arm assembly 62 as seen in FIG. 5.

As the door is moved to its closed condition, before force is needed to compress the hinge edge and latch edge portions of the continuous gasket 16, the antifriction roller 66 of the rocker arm assembly will come in contact with the door frame latch edge portion 32. At this point, the door latch handle 50 will be manually moved in downward direction so that the slide bar 56 will be moved downwardly carrying the rocker arm actuating pins 70 in the slots 60 with it. This will first bring the rocker arm antifriction roller 66 into contact with the inwardly facing working surface 48 of the latch plate finger 46. Subsequent downward movement of the door latch handle 50 will cause this roller 66, acting against the finger 46, to draw the door to its closed condition with respect to the door frame even against the force required to compress the hinged edge and latch edge portions of the continuous gasket 16. The door will now be latched and the parts will have position as seen in FIGS, 1, 3 and 4.

To unlatch the door, the operator reaches into the bottom part of the door opening 54 and manually pivots the door latch handle 50 outwardly until the rocker arm antifriction roller 66 again contacts the door frame latch edge portion 32. Until this point is reached, the friction of the continuous gasket between the door and the door frame will have resisted opening movement of the door with respect to the frame. Further movement of the door latch handle 50 in upward direction, however, will further rotate the rocker arm assembly with the rocker arm antifriction roller 66 rolling freely on the door frame latch edge portion so that the mechanical advantage of the handle acting on the slide bar 56 and the slide bar acting on the rocker arm actuating pin will easily overcome the frictional forces of the continuous gasket 16 between the door and the door frame. This action will continue until the parts again reach the position as seen in FIG. 5. When in this position, the door will have cleared the hinge edge and latch edge portions of the gasket 16 and the door can be opened further even more easily.

Although the present invention has been described with reference to preferred embodiments, workers skilled in the art will recognize that changes may be made in form and detail without departing from the spirit and scope of the invention.

What is claimed is:

1. A door latch apparatus for use in positively moving a door out of and into a finally closed condition with respect to a door frame wherein the initial and final movement of the door out of and into its closed condition with respect to the door frame must overcome substantial forces tending to retain the door in its closed condition and to resist movement of the door out of its closed condition, the door having a front outside surface and a back inside surface, a first hinged edge hinged to a first hinged edge of the door frame and a second latch edge opposite the first door hinged edge, the door latch edge being positioned to mate with a second latch edge of the door frame when the door is in closed condition, the door latch apparatus including:

(a) at least one latch plate fixedly mounted with respect to the latch edge of the door frame and extending outwardly therefrom in direction toward the door in position to be in adjacent relation to a latch edge portion of the door as the door is being closed, said latch plate being provided with a finger in spaced relation to the door frame latch edge, the finger providing an inwardly facing working surface extending in parallel relation to the latch edge;

(b) an elongate slide bar slidably mounted with respect to a latch edge portion of the door for longitudinal movement in direction parallel to the door latch edge, said slide bar having at least one transversely extending rocker arm actuating slot provided therein;

(c) a door latch handle accessible from the outside surface of the door and manually movable between a closed and an open position;

(d) means linking the door latch handle and the slide bar, said linking means being operable to move the slide bar between a first closed and a second open position upon movement of the handle between closed and open positions;

(e) at least one rocker arm assembly including:

(1) a rocker arm pivotally mounted with respect to the latch edge portion of the door and effectively pivoting in a plane parallel to the plane of the working surface of the latch plate finger, (2) a rocker arm roller rotatably mounted to a first end portion of the rocker arm in position to lie in the plane of the latch plate finger, and (3) a rocker arm actuating pin fixedly mounted to a second end portion of the rocker arm, extending transversely of the plane of movement of the rocker arm and situated within a transversely extending rocker arm actuating slot of the slide bar;

(f) wherein the parts are configured and positioned so that with the handle and slide bar in open position as the door is swung toward its closed condition, the rocker arm roller will initially contact the latch edge portion of the door frame, and with this roller in contact with the door frame, the door handle can be manually moved from open toward closed position, causing the roller to contact the working surface of the latch plate finger, further movement of the door handle towards closed position causing the rocker arm assembly to force the roller against the working surface of the latch plate finger drawing the door positively to its finally closed condition against any substantial forces tending to resist movement of the door to its finally closed condition.

2. The apparatus of claim 1 wherein:

(g) the parts are configured and positioned so that with the handle and latch in closed position and with the door in closed condition, manual movement of the door latch handle toward open position causes the rocker arm roller to initially contact, and then roll on, the door frame latch edge portion forcing the door latch edge portion and hinge edge portion away from the door frame latch and hinge edge portions against any substantial forces tending to initially resist movement of the door toward its open condition.

3. A door latch apparatus for use in positively moving a door finally into and initially out of a closed condition with respect to a door frame against substantial forces tending to finally resist movement of the door into its closed condition, and tending to initially retain the door in its closed condition, the door being partially bounded by a front outside surface, a first door hinged edge portion hinged to a first hinged edge portion of the door frame, and a second door latch edge portion opposite the first door hinged edge portion, the door latch edge portion being configured and positioned to mate with a second latch edge portion of the door frame when the door is in closed condition, the door latch apparatus including:

(a) at least one latch plate fixedly mounted with respect to the second latch edge portion of the door frame to lie generally in a single plane normal to the front outside door surface when the door is closed, the latch plate being provided with a finger having an inwardly facing working surface in spaced relation to the door latch edge portion and extending in parallel relation to that edge portion;

(b) a slide bar slidably mounted with respect to the latch edge portion of the door for longitudinal movement in direction parallel to the door latch edge portion between a first closed slide bar position and a second open slide bar position, said slide bar having at least one transversely extending rocker arm actuating slot provided therein;

(c) a door latch handle pivotally mounted to the door and accessible from the outside surface of the door, the handle being manually movable between a first closed and a second open position;

(d) means linking the door latch handle and the slide bar, said linking means being operable to move the slide bar between its first closed and its second open position upon movement of the handle between its first closed and second open positions;

(e) at least one rocker arm assembly including:

(1) a rocker arm lying in a single plane and pivotally mounted with respect to the latch edge portion of the door on a pivot axis so as to move in a plane generally parallel to the plane of the working surface of the latch plate finger as the door approaches its closed condition, (2) a rocker arm antifriction roller rotatably mounted to a first end portion of the rocker arm on an axis spaced from and parallel to the rocker arm pivot axis and in position to lie in the plane of the latch plate finger as the door closes, and (3) a rocker arm actuating pin fixedly mounted to a second end portion of the rocker arm to have a longitudinal axis parallel to but spaced from the rocker arm pivot axis, the pin extending transversely of the plane of movement of the rocker arm and situated within a rocker arm actuating slot of the slide bar;

(f) wherein the parts are so configured and positioned that with the handle and slide bar in open position as the door is swung toward its closed condition, the rocker arm roller will initially contact the latch portion of the door frame, and with this roller in contact with the door frame, the door handle can be moved manually from its open toward its closed position causing the roller to contact the working surface of the latch plate finger, further movement of the door handle toward closed position causing the rocker arm assembly to force the roller against the latch plate finger working surface drawing the door positively to its finally closed condition against any substantial forces tending to resist movement of the door toward its closed condition; and (g) wherein the parts are so configured and positioned that with the door in its closed condition, the door handle can be moved manually from its closed position toward its open position causing the roller to initially contact the latch edge portion of the door frame, further movement of the door handle toward its open position causing the rocker arm assembly to force the roller against the latch edge portion of the door frame forcing the door positively away from its closed condition against any substantial forces tending to initially retain the door in its closed condition.

4. A door latch apparatus for use in positively moving a door out of and into a finally closed condition with respect to a door frame wherein the initial and final movement of the door out of and into its closed condition with respect to the door frame must overcome substantial forces tending to retain the door in its closed condition and to resist movement of the door out of its closed condition, the door having a front outside surface and a back inside surface, a first hinged edge hinged to a first hinged edge of the door frame and a second latch edge opposite the first door hinged edge, the door latch edge being positioned to mate with a second latch edge of the door frame when the door is in closed condition, the door latch apparatus including:

(a) at least one latch plate fixedly mounted with respect to the latch edge of the door frame and extending outwardly therefrom in direction toward the door in position to be in adjacent relation to a latch edge portion of the door as the door is being closed, said latch plate being provided with a finger in spaced relation to the door frame latch edge, the finger providing an inwardly facing working surface extending in parallel relation to the latch edge;

(b) an elongate slide bar slidably mounted with respect to a latch edge portion of the door for longitudinal movement in direction parallel to the door latch edge, said slide bar having at least one transversely extending rocker arm actuating slot provided therein;

(c) a door latch handle accessible from the outside surface of the door and manually movable between a closed and an open position;

(d) means linking the door latch handle and the slide bar, said linking means being operable to move the slide bar between a first closed and a second open position upon movement of the handle between closed and open positions;

(e) at least one rocker arm assembly including:

(1) a rocker arm pivotally mounted with respect to the latch edge portion of the door and effectively pivoting in a plane parallel to the plane of the working surface of the latch plate finger, (2) a rocker arm roller rotatably mounted to a first end portion of the rocker arm in position to lie in the plane of the latch plate finger, and (3) a rocker arm actuating pin fixedly mounted to a second end portion of the rocker arm, extending transversely of the plane of movement of the rocker arm and situated within a transversely extending rocker arm actuating slot of the slide bar;

(f) wherein the parts are configured and positioned so that with the handle and slide bar in open position as the door is swung toward its closed condition, the rocker arm roller will initially contact the latch edge portion of the door frame, and with this roller in contact with the door frame, the door handle can be manually moved from open toward closed position, causing the roller to contact the working surface of the latch plate finger, further movement of the door handle towards closed position causing the rocker arm assembly to force the roller against the working surface of the latch plate finger drawing the door positively to its finally closed condition against any substantial forces tending to resist movement of the door to its finally closed condition; and (g) wherein the parts are configured and positioned so that with the handle and latch in closed position and with the door in closed condition, manual movement of the door latch handle toward open position causes the rocker arm roller to initially contact, and then roll on, the door frame latch edge portion forcing the door latch edge portion and hinge edge portion away from the door frame latch and hinge edge portions against any substantial forces tending to initially resist movement of the door toward its open condition.

* * * * *